US011679962B2

(12) United States Patent
Strassle et al.

(10) Patent No.: US 11,679,962 B2
(45) Date of Patent: Jun. 20, 2023

(54) SWITCH ASSEMBLIES, RAIL-MOUNTED LIFT SYSTEMS, AND RAIL-MOUNTED LIFT UNITS HAVING EMERGENCY STOP DEVICES

(71) Applicant: Liko Research & Development AB, Luleå (SE)

(72) Inventors: Derek Strassle, Endicott, NY (US); Joseph Blackmon, Cicero, NY (US); Sravan Mamidi, Columbus, NY (US); Ka Wing Calvin Peer, Ithaca, NY (US)

(73) Assignee: Liko Research & Development AB, Luleå (SE)

( * ) Notice: Subject to any disclaimer, the term of this patent is extended or adjusted under 35 U.S.C. 154(b) by 447 days.

(21) Appl. No.: 16/890,226

(22) Filed: Jun. 2, 2020

(65) Prior Publication Data

US 2020/0377347 A1 Dec. 3, 2020

Related U.S. Application Data

(60) Provisional application No. 62/856,311, filed on Jun. 3, 2019.

(51) Int. Cl.
*H01H 71/50* (2006.01)
*B66C 13/50* (2006.01)
(Continued)

(52) U.S. Cl.
CPC ..... *B66C 13/50* (2013.01); *B66C 13/22* (2013.01); *H01H 71/50* (2013.01); *H01H 71/68* (2013.01); *B66C 6/00* (2013.01)

(58) Field of Classification Search
CPC ..... A61G 2203/16; A61G 2203/46; A61G 2203/70; A61G 2203/20; A61G 2203/12;
(Continued)

(56) References Cited

U.S. PATENT DOCUMENTS 5,077,844 A 1/1992 Twitchell et al.
6,378,148 B1 4/2002 Votel
(Continued)

FOREIGN PATENT DOCUMENTS

CA 2390260 A1 5/2000
EP 1138303 A2 10/2001
(Continued)

OTHER PUBLICATIONS

Search Report dated Nov. 20, 2020 pertaining to European Patent Application No. EP20177666.3.

*Primary Examiner* — Bryan R Perez
(74) *Attorney, Agent, or Firm* — Dinsmore & Shohl LLP

(57) ABSTRACT

A switch assembly for a lift unit includes a switch, an emergency stop device, and a reset actuator. The switch is arranged to move between a closed position, wherein the switch electrically couples a lift motor of the lift unit to an energy source, and an open position, wherein the switch electrically decouples the lift motor from the energy source. The emergency stop device is coupled to the switch and arranged to move the switch from the closed position to the open position. The reset actuator is coupled to the switch and arranged to move the switch from the open position to the closed position, wherein the reset actuator is controllable to move the switch from the open position to the closed position.

20 Claims, 7 Drawing Sheets

(51) Int. Cl.
*B66C 13/22* (2006.01)
*H01H 71/68* (2006.01)
*B66C 6/00* (2006.01)

(58) Field of Classification Search
CPC .. A61G 7/1065; A61G 7/1015; A61G 7/1042; A61G 7/1061; B66C 6/00; B66C 13/22; B66C 13/50; H01H 71/68; H01H 71/50
See application file for complete search history.

(56) References Cited

U.S. PATENT DOCUMENTS

| | | | | |
|---|---|---|---|---|
| 9,877,885 | B2 | 1/2018 | Trepanier et al. | |
| 2010/0192296 | A1* | 8/2010 | Clough | B66D 3/20 5/83.1 |
| 2010/0270252 | A1* | 10/2010 | Chepurny | A61G 7/1061 212/76 |
| 2013/0111659 | A1 | 5/2013 | McKenzie | |
| 2014/0169795 | A1 | 6/2014 | Clough | |

FOREIGN PATENT DOCUMENTS

| | | | |
|---|---|---|---|
| EP | 3095430 | A2 | 11/2016 |
| WO | 2013016817 | A1 | 2/2013 |

* cited by examiner

SWITCH ASSEMBLIES, RAIL-MOUNTED LIFT SYSTEMS, AND RAIL-MOUNTED LIFT UNITS HAVING EMERGENCY STOP DEVICES

CROSS-REFERENCE TO RELATED APPLICATIONS

The present application claims the benefit of U.S. Provisional Application Ser. No. 62/856,311, filed Jun. 3, 2019, the entirety of which is incorporated by reference herein.

TECHNICAL FIELD

The present specification generally relates to rail-mounted lift systems and, more specifically, to devices for resetting rail-mounted lift units after activation of an emergency stop device.

BACKGROUND

Rail-mounted lifts may include a motorized lift strap, which may have a sling or other support structure coupled thereto to support a subject. During lifting or lowering, it may be desirable that movement of the motorized lift strap be stopped. At times when electrical controls are unresponsive to stop commands, an emergency stop may be provided to disconnect the electrical power from the motor of the lift unit. However, to reengage the electrical power to the motor, a user may need to reach the lift motor to manually reengage power. This may be difficult as the rail-mounted lift unit is well-above the ground making it difficult or inconvenient to reach.

Accordingly, a need exists for alternative rail-mounted lift units and systems to provide for easier reset of an rail-mounted lift unit after application of an emergency stop.

SUMMARY

In a first aspect, a rail-mounted lift unit includes a lift motor, a switch, an emergency stop device, a reset actuator, one or more user interface devices, and a control unit. The switch arranged to move between a closed position, wherein the switch electrically couples the lift motor to an energy source, and an open position, wherein the switch electrically decouples the lift motor from the energy source. The emergency stop device is coupled to the switch and arranged to move the switch from the closed position to the open position. The reset actuator is coupled to the switch and arranged to move the switch from the open position to the closed position. the control unit includes a processor coupled to a non-transitory memory storing computer readable and executable instructions. The control unit is communicatively coupled to the reset actuator and the one or more user interface devices. The control unit executes logic to receive a reset input from the one or more user interface devices, and move the switch from the open position to the closed position with the reset actuator when the reset input is received by the one or more user interface devices.

In a second aspect according to the first aspect, wherein the emergency stop device is further arranged to move the switch from the open position to the closed position.

In a third aspect according to any preceding aspect, wherein the reset actuator comprises a solenoid coupled to the switch.

In a fourth aspect according to any preceding aspect, wherein the one or more user interface devices comprises a primary control device and a secondary control device.

In a fifth aspect according to the fourth aspect, wherein the primary control device is a hand control unit.

In a sixth aspect according to the fourth aspect or the fifth aspect, wherein the secondary control device comprises a touchscreen display.

In a seventh aspect according to any preceding aspect, wherein the one or more user interface devices is configured to output a confirmation prompt, wherein the control unit, upon receiving the reset input from the one or more user interface devices, outputs the confirmation prompt with the one or more user interface devices.

In an eighth aspect according to any preceding aspect, wherein the one or more user interface devices comprise a touchscreen display.

In a ninth aspect according to the eighth aspect, wherein upon receiving the reset input with the one or more user interface devices, the control unit displays a confirmation prompt with the touchscreen display to request that a user confirm the reset input.

In a tenth aspect according to any preceding aspect, further comprising a pull-cord coupled to the emergency stop device.

In an eleventh aspect according to any preceding aspect, wherein the switch includes a lever arm coupled to the emergency stop device, wherein movement of the lever arm moves the switch between the closed position and the open position, and the reset actuator comprises: a solenoid, a plunger moveable by the solenoid, a support linkage coupled to the plunger, and a catch arm coupled to the support linkage and comprising a catch surface, wherein the reset actuator is configured to move the catch surface to contact and move the lever arm to cause the switch to move from the open position to the closed position.

In a twelfth aspect, a switch assembly for a lift unit includes a switch, an emergency stop device, and a reset actuator. The switch is arranged to move between a closed position, wherein the switch electrically couples a lift motor of the lift unit to an energy source, and an open position, wherein the switch electrically decouples the lift motor from the energy source. The emergency stop device is coupled to the switch and arranged to move the switch from the closed position to the open position. The reset actuator is coupled to the switch and arranged to move the switch from the open position to the closed position, wherein the reset actuator is controllable to move the switch from the open position to the closed position.

In a thirteenth aspect according to the twelfth aspect, wherein the switch includes a lever arm coupled to the emergency stop device, wherein movement of the lever arm moves the switch between the closed position and the open position, and the reset actuator includes a solenoid, a plunger moveable by the solenoid, a support linkage coupled to the plunger, and a catch arm coupled to the support linkage and comprising a catch surface, wherein the reset actuator is configured to move the catch surface to contact and move the lever arm to cause the switch to move from the open position to the closed position.

In a fourteenth aspect according to the twelfth aspect or the thirteenth aspect, further including a control unit include a processor coupled to a non-transitory memory storing computer readable and executable instructions, the control unit being communicatively coupled to the reset actuator, and one or more user interface devices communicatively coupled to the control unit. The control unit executes logic to receive a reset input from the one or more user interface devices, and move the switch from the open position to the closed position with the reset actuator when the reset input is received by the one or more user interface devices.

In a fifteenth aspect according to the fourteenth aspect, wherein the one or more user interface devices comprise a touchscreen display.

In a sixteenth aspect according to the fifteenth aspect, wherein upon receiving the reset input with the one or more user interface devices, the control unit displays a confirmation prompt with the touchscreen display to request that a user confirm the reset input.

In a seventeenth aspect, a rail-mounted lift system includes an overhead rail, and a rail-mounted lift unit arranged to traverse the overhead rail. The rail-mounted lift unit includes a lift motor, a switch, an emergency stop device, a reset actuator, one or more user interface devices, and a control unit. The switch is arranged to move between a closed position, wherein the switch electrically couples the lift motor to an energy source, and an open position, wherein the switch electrically decouples the lift motor from the energy source. The emergency stop device is coupled to the switch arranged to move the switch from the closed position to the open position. The reset actuator is coupled to the switch and arranged to move the switch from the open position to the closed position. The one or more user interface devices includes a touchscreen display. The control unit includes a processor coupled to a non-transitory memory storing computer readable and executable instructions. The control unit is communicatively coupled to the reset actuator and the one or more user interface devices, wherein the control unit executes logic to receive a reset input from the one or more user interface devices, and move the switch from the open position to the closed position with the reset actuator when a reset input is received by the one or more user interface devices.

In an eighteenth aspect according to the seventeenth aspect, wherein the switch includes a lever arm coupled to the emergency stop device, wherein movement of the lever arm moves the switch between the closed position and the open position.

In a nineteenth aspect according to the seventeenth aspect or the nineteenth aspect, the reset actuator includes a solenoid, a plunger moveable by the solenoid, a support linkage coupled to the plunger, and a catch arm coupled to the support linkage and comprising a catch surface, wherein the reset actuator is configured to move the catch surface to contact and move the lever arm to cause the switch to move from the open position to the closed position.

In a twentieth aspect according to any of the seventeenth aspect through the nineteenth aspect, wherein upon receiving the reset input with the one or more user interface devices, the control unit displays a confirmation prompt with the touchscreen display to request that a user confirm the reset input.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
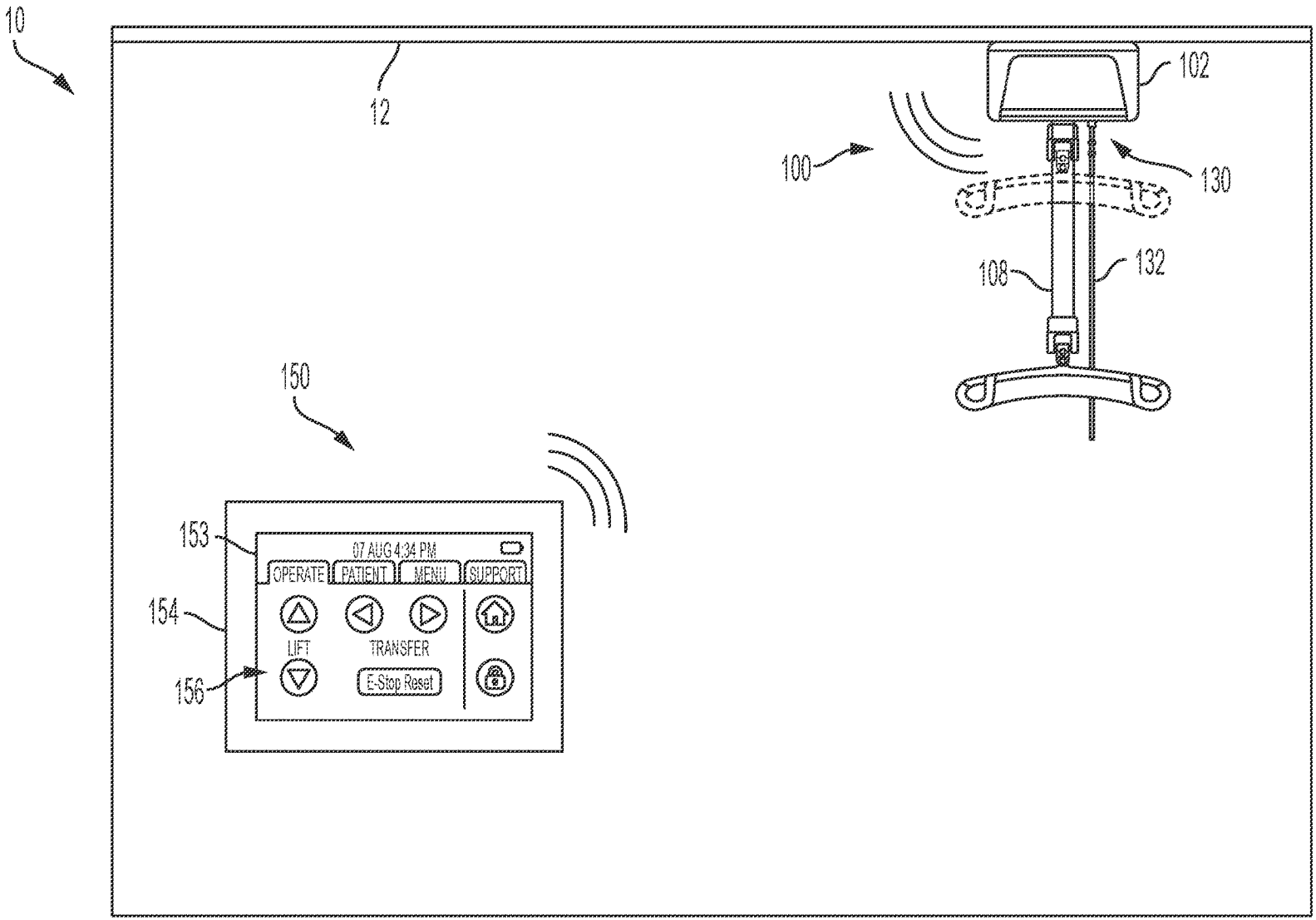
FIG. 1 generally depicts an illustrative rail-mounted lift system having one or more user input devices for resetting the rail-mounted lift system to an operational state, according to one or more embodiments shown and described herein.

FIG. 1 generally depicts one embodiment of a rail-mounted lift system. The rail-mounted lift system may generally include a lift unit slidably coupled to an overhead rail via a lift carriage. The overhead rail may extend along a ceiling of a space, such as various rooms and corridors of a hospital, a medical facility, or even a home. The lift unit may be provided with an emergency stop device, that when activated, prevents the lift unit from performing a lifting/and or lowering movement of a lifting strap. As will be described in greater detail herein, the lift unit is provided with a reset actuator to reset the lift unit to an operating condition after engagement of the emergency stop device. The reset actuator may be communicatively coupled to one or more user interface devices to provide remote reset of the lift unit. That is, after actuation of the emergency stop, a user may be able reset the lift unit to an operating condition without having to directly contact the lift unit to reset the lift unit and/or the emergency stop device. Accordingly, a user would not have to use a ladder to reset the lift unit and would not have to remove the lift unit from the overhead rail to reset the lift unit, which may be tedious and time consuming. The rail-mounted lift system and the various components of the rail-mounted lift system will be described in more detail herein with specific reference to the appended figures.

Figure 2:
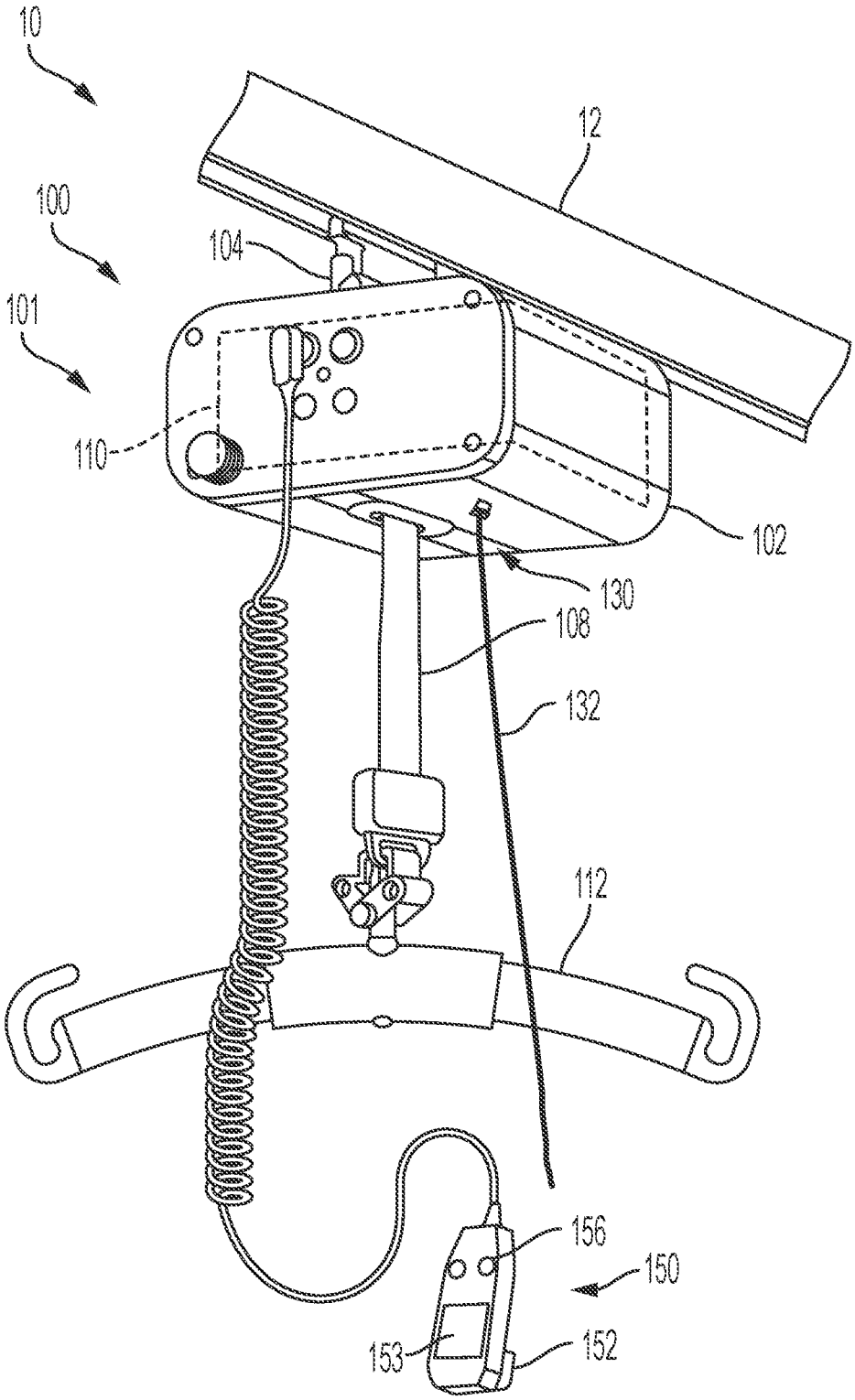
FIG. 2 generally depicts an rail-mounted lift unit mounted to an overhead rail, according to one or more embodiments shown and described herein.

Referring collectively the FIGS. 1 and 2, the rail-mounted lift system 10 generally includes a rail-mounted lift unit 100 coupled to an overhead rail 12. The overhead rail 12 may be secured to a ceiling of the care room, as illustrated in FIG. 1. Specifically, the overhead rail 12 may be secured to structural elements of the ceiling, such as ceiling joists, by suitable fastening elements. In some embodiments, the overhead rail 12 may be suspended from the ceiling of the care room by pendants. In other embodiments, it is contemplated that the overhead rail 12 may be directly secured to the ceiling. The overhead rail 12 and the rail-mounted lift unit 100 may be positioned well-above the floor, which may make directly accessing the over lift unit 100 difficult or inconvenient for a user standing on the floor.

The lift unit 100 may include a lift housing 102 that forms an enclosure around the various components of the lift unit 100 such as a frame, a lift motor, and the like. A lift carriage 104 may be coupled to the lift housing 102. The lift carriage 104 engages the overhead rail 12 such that the lift unit 100 is suspended from the overhead rail 12. In embodiments, the lift carriage 104 may also facilitate translation of the lift unit 100 along the overhead rail 12 with support wheels (not shown) rotatably affixed to the lift carriage 104. In some embodiments, the support wheels of the lift carriage 104 may be motorized such that the support wheels may be selectively rotated to translate the lift carriage 104 and attached lift unit 100 along the overhead rail 12. In other embodiments, the rail-mounted lift unit 100 may move by manually pulling the rail-mounted lift unit 100 along the overhead rail 12 by, for example, a tether, leash, or lifting strap 108.

The lift unit 100 may be used to support and/or lift a subject with the lifting strap 108, which is coupled to a lift motor 110 supported within the lift housing 102 of the lift unit 100. Specifically, the lift strap 110 may be coupled to a drum (not depicted) which, in turn, is coupled to an armature of the lift motor 110 such that rotation of the armature rotates the drum, thereby taking-up or paying-out the lifting strap 108 from the lift unit 100. Accordingly, it should be understood that the lift motor 110 facilitates extending and/or or retracting the lifting strap 108 relative to the lift housing 102, thereby raising and lowering a subject attached to the lifting strap 108.

In the embodiment of the rail-mounted lift system 10 shown in FIG. 2, a subject may be attached to the lifting strap 108 with a sling bar 112 or a similar accessory attached to the lifting strap 108. More specifically, the sling bar 112 or a similar accessory may be attached to a harness or sling in which the subject is positioned, thereby facilitating the lifting and/or lowering operation.

As will be described in greater detail herein, in some embodiments, it may be desirable to stop or prevent a lifting and/or lowing action of the lift unit 100. In such embodiments, an emergency stop device 130 may be arranged to discontinue the supply of power to the lift motor 110 from an energy source. For example, the emergency stop device 130 may be coupled to the lift housing 102 and actuatable by a user (e.g., through a pull-cord 132) to discontinue the supply of power to the lift motor 110 from an energy source thereby preventing any further lifting or lowering operations until the lift unit 100 is reset to an operational condition.

Referring to FIG. 1, various operations of the lift unit 100 and/or components thereof, may be operated with one or more user interface devices 150 that are communicatively coupled to the lift unit 100. For example, lifting/lowering, movement along the overhead rail 12, and the like. In embodiments, the one or more user interface devices 150 may include controllers that are configured for wired or wireless communication with the lift unit 100. The one or more user interface devices 150 that provide wireless communication with the lift unit may be used to operate the lift unit remotely (e.g., from a wall-mounted control unit 154 or other wireless controller as depicted in FIG. 1). For example, lifting/lowering, movement along the overhead rail 12, and the like, may be controlled from the one or more user interface devices 150. As will be described in greater detail herein, the one or more user interface devices may also be used to remotely reset the lift unit 100 to an operational condition after actuation of the emergency stop device 130 is used to discontinue the supply of power to the lift unit 100.

Figure 3:
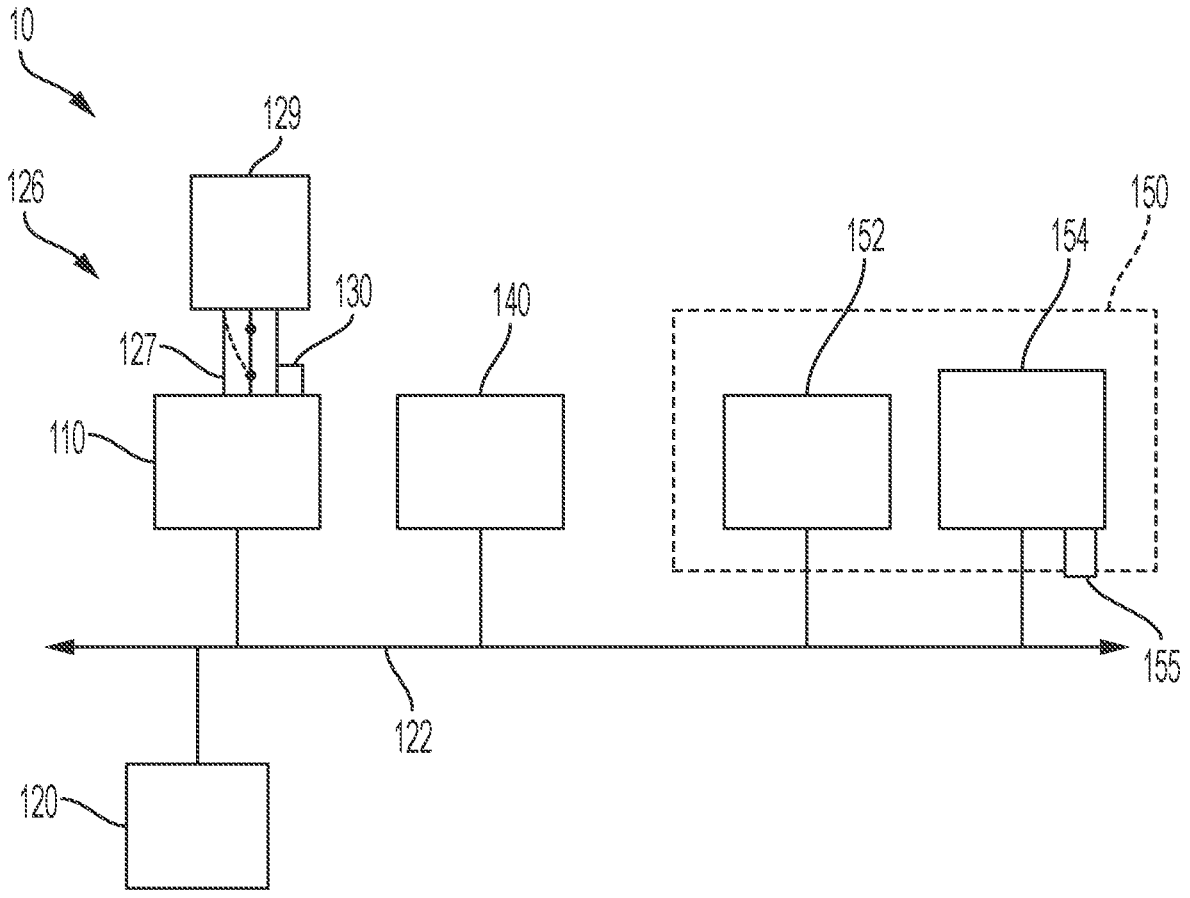
FIG. 3 depicts a block diagram illustrating the interconnectivity of various components of the rail-mounted lift system of FIG. 1, according to one or more embodiments described herein.

FIG. 3 depicts a block diagram illustrating the interconnectivity between various components of the rail-mounted lift system 10. As illustrated the rail-mounted lift system 10 may include a communication path 122, a control unit 120, a lift motor 110 having an emergency stop device 130 operable to disconnect the lift motor 110 from an energy source 129, a reset actuator 140, and the one or more user interface devices 150. It is noted that rail mounted lift systems according to the present disclosure may include a fewer or greater number of components without departing from the scope of the present disclosure. As will be described in more detail herein, reset actuator 140 may be part of a switch assembly, that is configured to selectively connect and disconnect the lift motor 130 from the energy source 129.

The various components of the rail-mounted lift system 10 may be communicatively coupled to one another over the communication path 122. The communication path 122 may be formed from any medium that is capable of transmitting a signal such as, for example, conductive wires, conductive traces, optical waveguides, or the like. In some embodiments, the communication path 122 may facilitate the transmission of wireless signals, such as WiFi, Bluetooth, DSRC, and the like. Moreover, the communication path 122 may be formed from a combination of mediums capable of transmitting signals. In one embodiment, the communication path 122 includes a combination of conductive traces, conductive wires, connectors, and buses that cooperate to permit the transmission of electrical data signals to components such as processors, memories, sensors, input devices, output devices, and communication devices. Accordingly, the communication path 122 may comprise a bus, such as for example a LIN bus, a CAN bus, a VAN bus, and the like. Additionally, it is noted that the term "signal" means a waveform (e.g., electrical, optical, magnetic, mechanical or electromagnetic), such as DC, AC, sinusoidal-wave, triangular-wave, square-wave, vibration, and the like, capable of traveling through a medium.

The control unit 120 may be communicatively coupled to the various components of the rail-mounted lift system 10 with communication path 122. The control unit 120 may include one or more processors and one or more memory modules. In the embodiments described herein, the one or more memory modules may be non-transitory memory modules which include machine readable and executable instructions for controlling various operations of the rail-mounted lift unit 100. For example, and as will be described in greater detail herein, the control unit 120 may control the reset actuator 140 to reset the rail-mounted lift unit 100 to be operable to lift and lower the lifting strap 108 after activation of the emergency stop device 130 (e.g., by pulling on pull-cord 132 illustrated in FIGS. 1 and 2).

Each of the one or more processors of the control unit 120 may be any device capable of executing machine readable instructions. Accordingly, each of the one or more processors may be a controller, an integrated circuit, a microchip, a computer, or any other computing device.

The memory, such as read only memory (ROM) and random access memory (RAM), may constitute illustrative memory devices (i.e., non-transitory, processor-readable storage media). Such memory may include one or more machine readable instructions thereon that, when executed by the processing device, cause the processor to complete various processes and functions, such as various operations of the lift units described herein. Optionally, the machine readable instructions may be stored on a tangible computer-readable medium such as a digital disk, flash memory, a memory card, a USB drive, an optical disc storage medium (e.g., Blu-Ray™, CD, DVD), and/or other non-transitory processor-readable storage media.

The one or more user interface devices 150 may be communicatively coupled to the control unit 120 over the communication path 122. For example, the one or more user interface devices 150 may be hardwired to the lift unit 100 to provide communication between the one or more user interface devices 150 and the controller or they may be wirelessly paired with the lift unit 100 (e.g., through Bluetooth, WiFi, cellular networks, or the like) to enable remote operation of the lift unit 100 as noted above.

The one or more user interface devices 150, may include a primary control device and a secondary control device. For example, the one or more user interface devices 150 may include a hand control unit 152 (e.g., the primary control device) that is communicatively coupled to the lift unit 100 as depicted in FIG. 2 and/or a remote control unit (e.g., the secondary control device) such as a wall-mounted control unit 154, depicted in FIG. 1.

Still referring to FIGS. 1 and 2, the one or more user interface devices 150 (e.g., wall-mounted control unit 154 and/or hand control unit 152) include one or more components that control the lift unit 100 (e.g., causing the motor within the lift unit 100 to extend or retract the lifting strap 108 thereby moving components attached to the lift strap 108 up/down, moving the lift unit 100 laterally along the overhead rail 12, activating the lift unit 100, pairing a subject with a lift unit 100, returning a lift unit 100 to a "home" position/location, receiving information from a lift unit 100 (e.g., battery status, weight of load supported by lift unit 100, etc.), performing an emergency stop of the lift unit 100, resetting the lift unit 100, and/or the like. The one or more user interface devices 150 may include, for example, a display 153 and/or one or more user interface controls 156. The display 153 may be, for example and without limitation, any liquid crystal display (LCD), light emitting diode (LED) display 153, electronic ink (e-ink) display 153, or the like that can display 153 information to a user. In some embodiments, the display 153 may be configured as an interactive display that can receive user inputs (e.g., a touch screen display or the like). The one or more user interface controls 156 may be hardware components that receive inputs from a user and transmit signals corresponding to the inputs, such as a keyboard, a mouse, a joystick, a touch screen, a remote control, a pointing device, a video input device, an audio input device, a haptic feedback device, and/or the like. In some embodiments, the display 153 and one or more of the user interface controls 156 may be combined into a single device, such as a touchscreen display (such as illustrated in FIG. 1) or the like. The display 153 and/or the one or more user interface controls 156 may be used, for example, to allow a user to interact with the one or more user input devices for the purpose of moving components attached to the lift strap 108 up/down, moving the lift unit 100 laterally along the overhead rail 12, activating the lift unit 100, pairing a subject with a lift unit 100, returning a lift unit 100 to a "home" position/location, receiving information from a lift unit 100 (e.g., battery status, weight of load supported by lift unit 100, etc.), performing an emergency stop of the lift unit 100, resetting the lift unit 100 with the reset actuator 140, and/or the like.

In the embodiment shown in FIG. 2, the hand control unit 152 is directly wired to the lift unit 100. However, it should be understood that, in other embodiments, the hand control unit 152 may be wirelessly coupled to the lift unit 100 to facilitate remote operation of the lift unit 100. In other embodiments, the hand control unit 152 may be omitted, such as when the lift unit 100 only comprises the wall-mounted control unit 154. In some embodiments, as illustrated in FIG. 2, the hand control unit 152 may include a display 153 and/or one or more user interface controls 156, as discussed above.

Still referring to FIG. 3, as noted above, the rail-mounted lift unit 100 includes at least one lift motor 110. As noted above, the lift motor 110 may be housed within lift housing 102. The lift motor 110 is operatively coupled to the lifting strap 108 to take-up the lifting strap 108 into the lift housing 102 and pay-out the lifting strap 108 from the lift housing 102, as illustrated in FIG. 1. The lift motor 110 may be communicatively coupled to the control unit 120 such that the control unit 120 can control operation of the lift motor 110 to pay out or wind up the lift strap. For example, the control unit 120 may receive a user instruction over the one or more user interface devices 150 to pay-out of take-up the lift strap. As will be described below, the lift motor 110 may be electrically coupled to an energy source 129 such as a battery or other voltage source, via an electrical coupling device such as switch 127 of switch assembly 126.

The switch assembly 126 may include various communicatively coupled components including, for example, the control unit 120, the reset actuator 140, and the one or more user interface devices 150. In some embodiments, the switch assembly 126 may include a greater or few number of communicatively coupled components without departing from the scope of the present disclosure.

The switch assembly 126 further includes an emergency stop device 130. The emergency stop device 130 may be any device capable of discontinuing the delivery of power from the energy source 129 to the lift motor 110. For example, the emergency stop device 130 may be a button, a lever, a switch, or the like coupled to the lift housing 102 of the lift unit 100. A pull-cord 132 may be coupled to the emergency stop device 130 and extend vertically (i.e., downward) therefrom to allow for manual application of a pulling force to engage the emergency stop device 130 and stop operation of the lift unit 100. The pull-cord 132 may be positioned adjacent to the lifting strap 108 to provide easy access for a person supported by the lift unit 100.

Figure 4A:
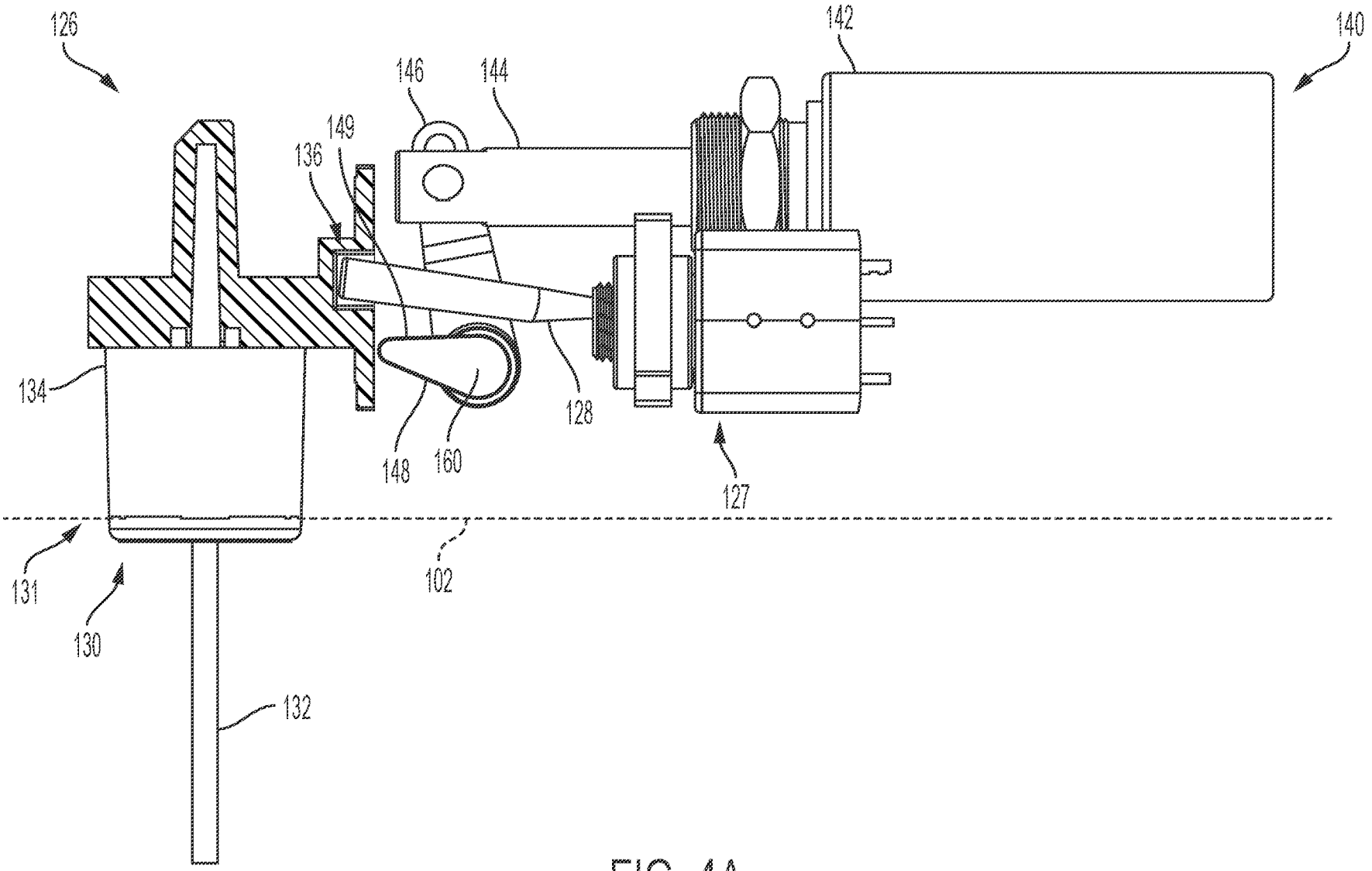
FIG. 4A depicts an emergency switch assembly of the rail-mounted lift system of FIG. 1 in a normal operating position, according to one or more embodiments shown and described herein.

In embodiments, the emergency stop device 130 is operatively coupled to the switch 127 so as to facilitate actuating the switch 127 from a closed position in which power is distributed from the energy source to the lift motor 110 energy source 129, to an open position, wherein the lift motor 110 is electrically decoupled (i.e., unable to receive power) from the energy source 129. Referring to FIG. 4A by way of example, a user may pull the emergency stop device 130 (e.g., with the pull-cord 132) when the lift motor 110 lifting or lowering the lifting strap 108. Pulling the pull-cord 132 of the emergency stop device 130 actuates the switch 127 from the closed position to the open position thereby discontinuing power distribution to the lift motor 110 and stopping the lift motor 110. In some embodiments, the emergency stop device 130 may be preemptively activated to prevent inadvertent use of the lifting/lowering function of the lift unit 100. In some embodiments, the emergency stop device 130 may be manually actuated to move the switch 127 from the open position to the closed position (e.g., by applying a positive pressure to the emergency stop device 130 to push the emergency button 131 back to a pre-actuation state).

Figure 4B:
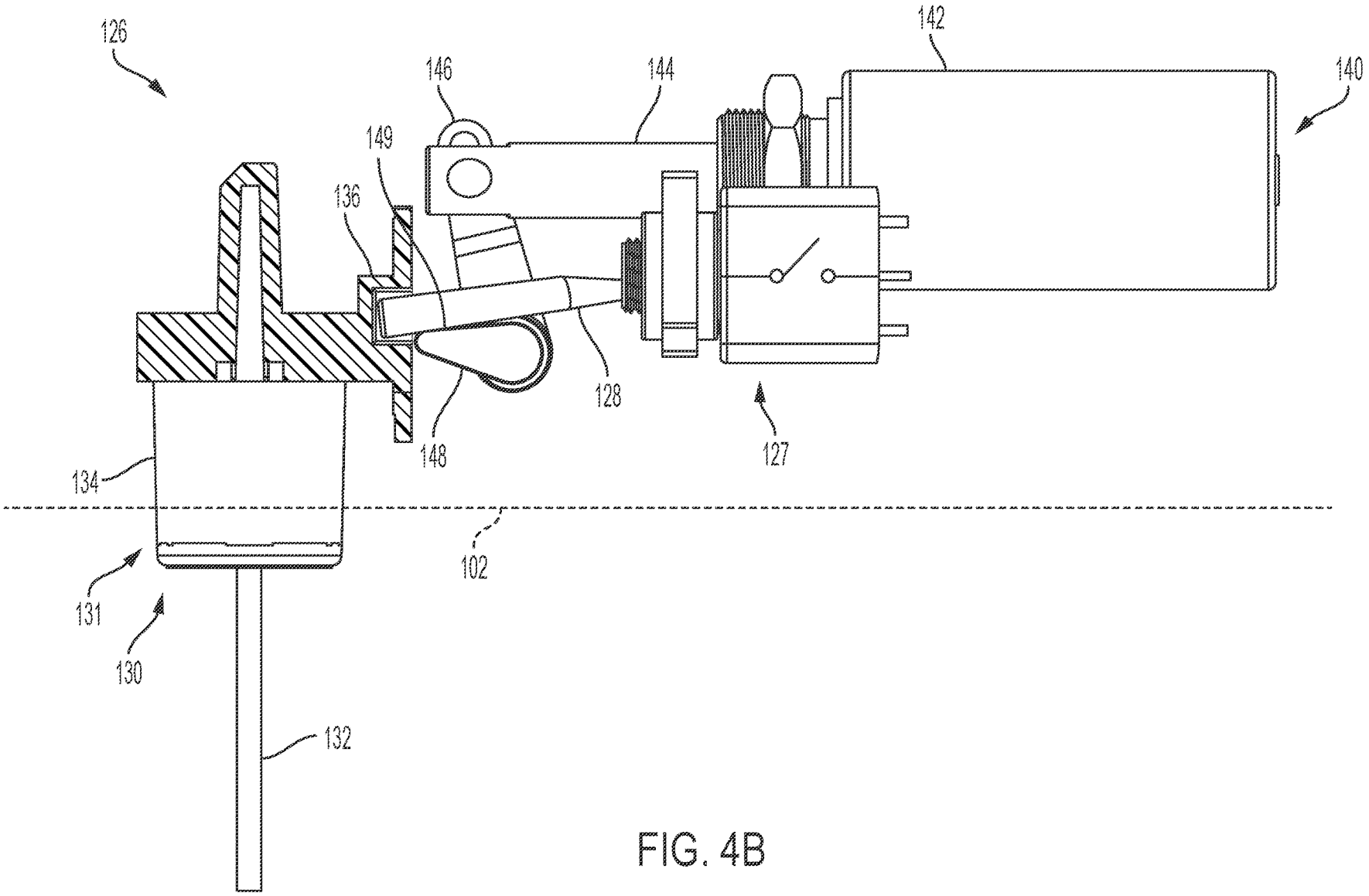
FIG. 4B schematically depicts the emergency switch assembly of FIG. 4A in an emergency switch activated position, according to one or more embodiments described herein.
Figure 4C:
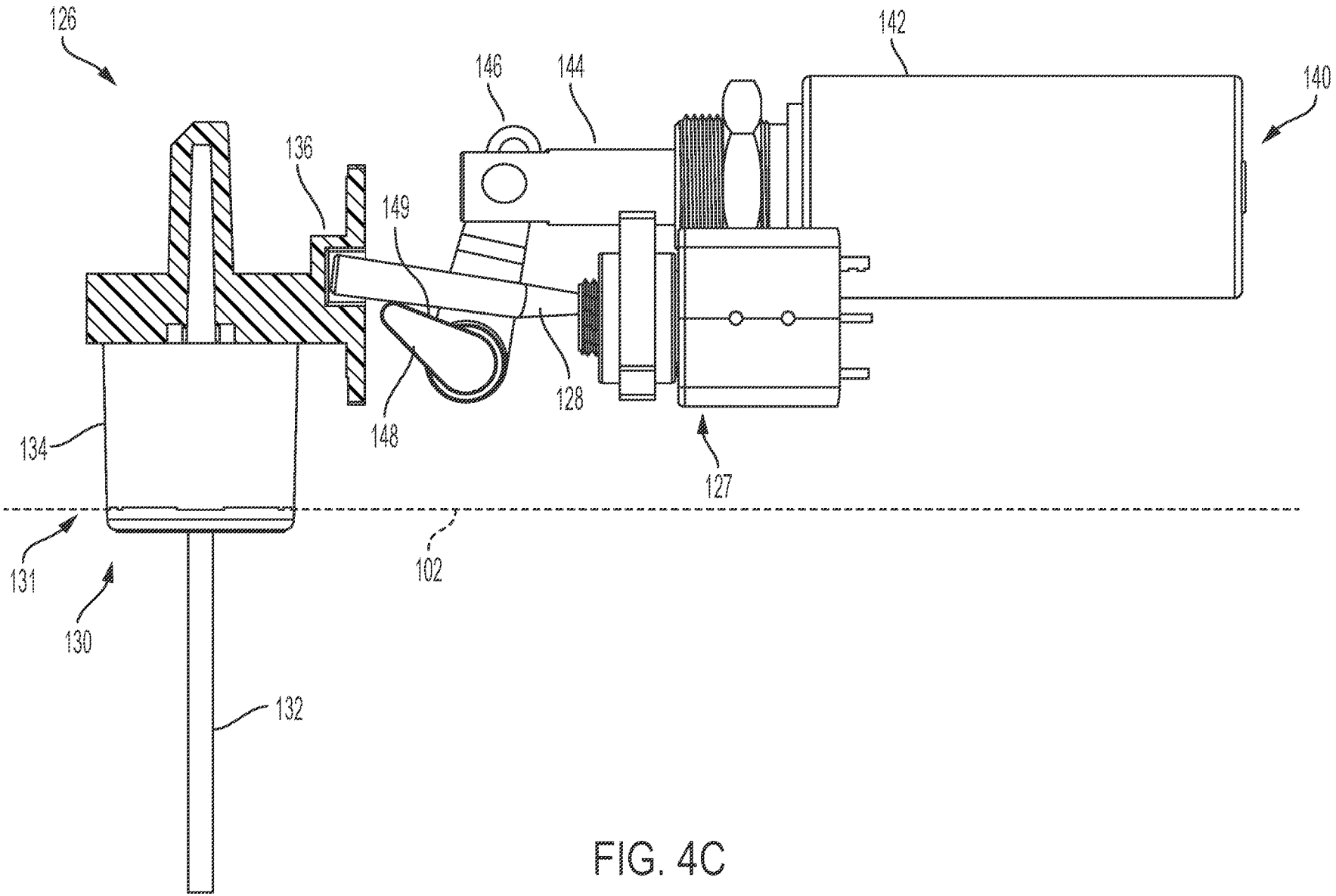
FIG. 4C schematically depicts the emergency switch assembly of FIG. 4B in a reset position, according to one or more embodiments shown and described herein.

FIGS. 4A-4C illustrate a more detailed view of the switch assembly 126, according to one or more embodiments. FIG. 4A illustrates the switch assembly 126 during normal operation of the lift unit 100. That is, FIG. 4A illustrates the emergency stop device 130 prior to activation of the emergency stop device 130. In such embodiment, the emergency stop device 130 is a button 131 having a body 134. The body 134 of the button 131 is partially positioned within the lift housing 102 and may be moveable relative to the lift housing 102 so as to be able to extend further out of the lift housing 102 when actuated to facilitate an emergency stop of the lift unit 100 (e.g., FIG. 4B). The pull-cord 132 extends from the button 131 so as to be manipulated by a user. The button 131 may be mechanically coupled to switch 127 through lever arm 128 which is operable to close and open the switch 127. For example, the body 134 of the button 131 may define a recess 136 an end of the lever arm 128 may be positioned in the recess.

As illustrated in FIG. 2, when the button 131 is pulled (such as by pulling the pull-cord 132), the body 134 of the button 131 may extend further outside of the lift housing 102 and pull the lever arm 128 from the first position shown in FIG. 4A wherein the switch 127 is closed to a second position shown in FIG. 4B wherein the switch 127 is open. As described above, when the switch 127 is open, the lift motor 110 is electrically decoupled from the energy source 129, thereby preventing the flow of power from the energy source 129 to the lift motor 110, as illustrated in FIG. 3.

Once the emergency stop device 130 moves the switch 127 from the closed position to the open position, the switch 127 may remain open until closed either manually or with the reset actuator 140. For example, to manually close the switch 127, a user may ascend to a height of the lift unit 100 (e.g., with a ladder) or remove the lift unit 100 from the overhead rail 12, and push the button 131 to move the lever arm 128 back to the first position, thereby closing the switch 127 and resetting the emergency stop device 130. However, as noted above, manually closing the switch 127 may be tedious and time consuming for the user. Accordingly, embodiments described herein include a reset actuator 140 to allow for remote reset of the lift unit 100.

As illustrated in FIG. 3, the reset actuator 140 of the switch assembly 126 is communicatively coupled to the control unit 120 over the communication path 122. The reset actuator 140 may be any device configured to move the switch 127 from the open position to the closed position after actuation of the emergency stop device 130. For example, the reset actuator 140 may include a linear actuator such as a solenoid 142 configured to move a plunger 144. The solenoid 142 may be electrically coupled to the energy source 129 or to a separate energy source. It is noted that while a solenoid is described, any type of actuator may be used that is operable move plunger 144. For example, the reset actuator 140 may include an electromechanical actuator, a mechanical actuator, or the like as an alternative to the solenoid 142.

In some embodiments, the plunger 144 may be arranged to directly contact the lever arm 128 to toggle the lever arm 128 and actuate the switch 127 from the open position to the closed position to reset the left unit 100. In some embodiments, a support linkage 146 may be pivotally coupled to the end of the plunger 144 as depicted in the figures. The support linkage 146 may be pivotally coupled to a support structure (not shown) within the lift housing 102 about pivot 160. Coupled to the support linkage 146 or otherwise defined by the support linkage 146 may be a catch arm 148 defining a catch surface 149. Movement of the plunger 144 by the solenoid 142 causes rotation of the catch arm 148 and catch surface 149 about the pivot 160. As illustrated in FIG. 4B, when the button 131 is actuated such that the lever arm 128 moves to the second position (i.e., the open position), the lever arm 128 may contact or come in close proximity to the catch surface 149 of the catch arm 148.

When it is desired that the lift unit 100 again be operational to lift and/or lower the lifting strap 108, a user may input with the one or more user interface devices 150 a reset input. The control unit 120 may receive the reset input from the one or more user interface devices 150. The control unit 120 may then operate the reset actuator 140 to move the switch 127 from the open position to the closed position. For example, the control unit 120 may operate the solenoid 142 to, for example, shorten an exposed length of the plunger 144 to rotate the catch surface 149 in a clockwise direction to push the lever arm 128 back to the first position which, in turn, translates the button 131 back to the first position, thereby closing the switch 127 and resetting the lift unit 100 to an operational state. In some embodiments, the solenoid 142 may automatically rotate the catch surface 149 of the catch arm 148 back to its original position after resetting the lift unit 100 to an operational state.

Figure 5:
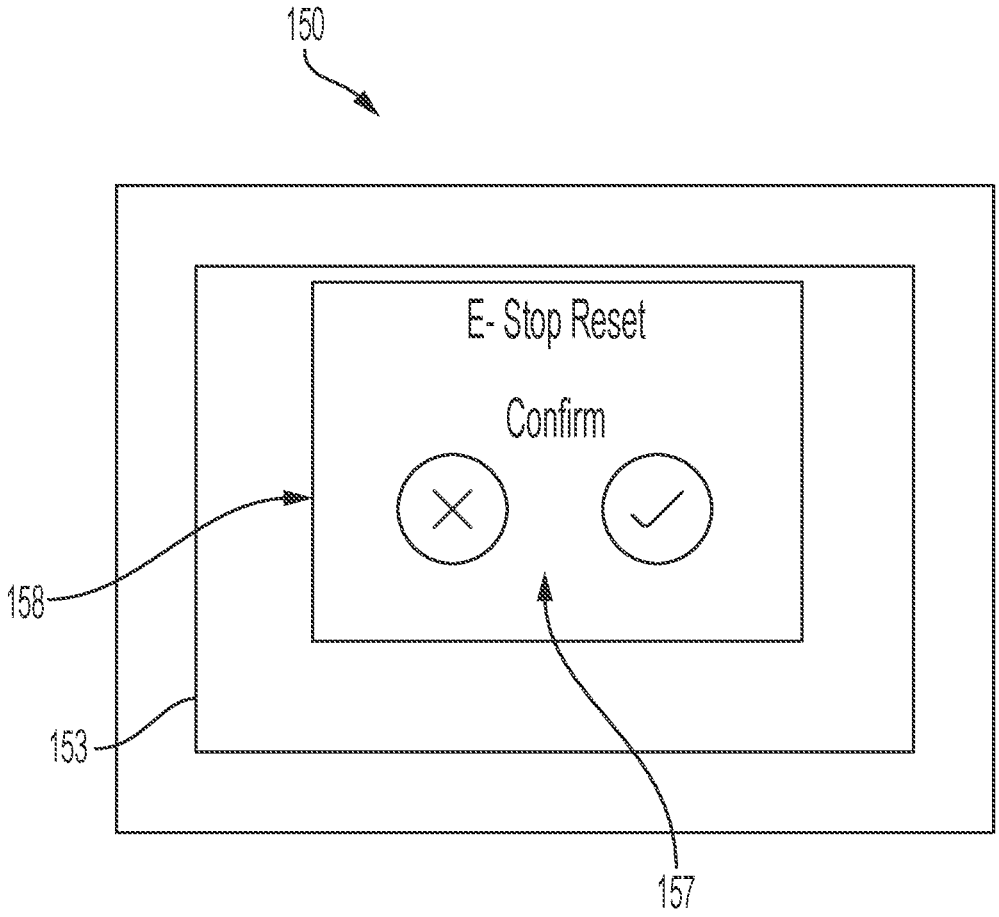
FIG. 5 depicts a user input and/or output device have a confirmation output, according to one or more embodiments shown and described herein.

In some embodiments, when the control unit 120 receives a reset input from the one or more user interface devices 150, the control unit 120 may output a confirmation prompt, prompting the user to confirm the instruction to reset the lift unit 100 to the operating condition. For example, and as illustrated in FIG. 5, wherein the one or more user interface devices 150 includes a touch screen, a confirmation pop-up 158 may be displayed, with options 157 selectable by the user to confirm or reject the reset input. In other embodiments, such as where there is not a display 153, the confirmation prompt may include an audible alert, a vibratory alert, or a visual alert (e.g., light), requesting confirmation. Confirmation may be provided by a second reset input, a reset input pattern (e.g., holding a button on the user interface device for a set period of time, inputting a predetermined code or pattern, etc.), or the like.

In some embodiments, the one or more user interface devices 150 may include a sensor 155 configured to output a confirmation signal, indicating that the reset request was not incidental but intended. For example, the sensor 155 may be a heat sensor (e.g., a thermistor) calibrated to output a heat detection signal. The control unit 120 may determine an intention of the user to input a reset input with the one or more user interface devices 150 when the heat detection signal is indicative of the temperature of a user's hand (e.g., body temperature) being used to actuate the one or more user interface devices 150. For example, sensing the body temperature of the user's hand may be indicative of an intentional reset versus an inadvertent contact.

It should now be understood that rail-mounted lift system as described herein may generally include a lift unit slidably coupled to a rail via a carriage. The lift unit is provided with an emergency stop device, that when activated, prevents the lift unit from performing a lifting/and or lowering movement. A reset actuator is provided to reset the lift unit to an operating condition after engagement of the emergency stop device. The reset actuator may be communicatively coupled to one or more user interface devices to provide remote reset of the lift unit. That is, after actuation of the emergency stop, the user will be able reset the lift unit to an operating condition without having to directly contact the lift unit to reset the lift unit and/or the emergency stop device. Accordingly, a user would not have to use a ladder to reset the lift unit and would not have to remove the lift unit from the overhead rail to reset the lift unit, which may be tedious and time consuming.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A rail-mounted lift unit comprising:

a lift motor, a switch arranged to move between a closed position, wherein the switch electrically couples the lift motor to an energy source, and an open position, wherein the switch electrically decouples the lift motor from the energy source;

an emergency stop device coupled to the switch and arranged to move the switch from the closed position to the open position;

a reset actuator coupled to the switch and arranged to move the switch from the open position to the closed position;

one or more user interface devices; and a control unit comprising a processor coupled to a non-transitory memory storing computer readable and executable instructions, the control unit being communicatively coupled to the reset actuator and the one or more user interface devices, wherein the control unit executes logic to:

receive a reset input from the one or more user interface devices; and move the switch from the open position to the closed position and reset the emergency stop device with the reset actuator when the reset input is received by the one or more user interface devices.

2. The rail-mounted lift unit of claim 1, wherein the emergency stop device is further arranged to move the switch from the open position to the closed position.

3. The rail-mounted lift unit of claim 1, wherein the reset actuator comprises a solenoid coupled to the switch.

4. The rail-mounted lift unit of claim 1, wherein the one or more user interface devices comprises a primary control device and a secondary control device.

5. The rail-mounted lift unit of claim 4, wherein the primary control device is a hand control unit.

6. The rail-mounted lift unit of claim 4, wherein the secondary control device comprises a touchscreen display.

7. The rail-mounted lift unit of claim 1, wherein the one or more user interface devices is configured to output a confirmation prompt, wherein the control unit, upon receiving the reset input from the one or more user interface devices, outputs the confirmation prompt with the one or more user interface devices.

8. The rail-mounted lift unit of claim 1, wherein the one or more user interface devices comprise a touchscreen display.

9. The rail-mounted lift unit of claim 8, wherein upon receiving the reset input with the one or more user interface devices, the control unit displays a confirmation prompt with the touchscreen display to request that a user confirm the reset input.

10. The rail-mounted lift unit of claim 1, further comprising a pull-cord coupled to the emergency stop device.

11. The rail-mounted lift unit of claim 1, wherein:

the switch comprises a lever arm coupled to the emergency stop device, wherein movement of the lever arm moves the switch between the closed position and the open position; and the reset actuator comprises:

a solenoid;

a plunger moveable by the solenoid;

a support linkage coupled to the plunger; and a catch arm coupled to the support linkage and comprising a catch surface, wherein the reset actuator is configured to move the catch surface to contact and move the lever arm to cause the switch to move from the open position to the closed position.

12. A switch assembly for a lift unit, the switch assembly comprising:

a switch arranged to move between a closed position, wherein the switch electrically couples a lift motor of the lift unit to an energy source, and an open position, wherein the switch electrically decouples the lift motor from the energy source;

an emergency stop device coupled to the switch and arranged to move the switch from the closed position to the open position; and a reset actuator coupled to the switch and arranged to move the switch from the open position to the closed position, wherein the reset actuator is controllable to move the switch from the open position to the closed position and reset the emergency stop device.

13. The switch assembly of claim 12, wherein:

the switch comprises a lever arm coupled to the emergency stop device, wherein movement of the lever arm moves the switch between the closed position and the open position; and the reset actuator comprises:

a solenoid;

a plunger moveable by the solenoid;

a support linkage coupled to the plunger; and a catch arm coupled to the support linkage and comprising a catch surface, wherein the reset actuator is configured to move the catch surface to contact and move the lever arm to cause the switch to move from the open position to the closed position.

14. The switch assembly of claim 12, further comprising:

a control unit comprising a processor coupled to a non-transitory memory storing computer readable and executable instructions, the control unit being communicatively coupled to the reset actuator; and one or more user interface devices communicatively coupled to the control unit, wherein the control unit executes logic to:

receive a reset input from the one or more user interface devices; and move the switch from the open position to the closed position with the reset actuator when the reset input is received by the one or more user interface devices.

15. The switch assembly of claim 14, wherein the one or more user interface devices comprise a touchscreen display.

16. The switch assembly of claim 15, wherein upon receiving the reset input with the one or more user interface devices, the control unit displays a confirmation prompt with the touchscreen display to request that a user confirm the reset input.

17. A rail-mounted lift system comprising:

an overhead rail; and a rail-mounted lift unit arranged to traverse the overhead rail, the rail-mounted lift unit comprising:

a lift motor;

a switch arranged to move between a closed position, wherein the switch electrically couples the lift motor to an energy source, and an open position, wherein the switch electrically decouples the lift motor from the energy source;

an emergency stop device coupled to the switch and arranged to move the switch from the closed position to the open position;

a reset actuator coupled to the switch and arranged to move the switch from the open position to the closed position;

one or more user interface devices comprising a touchscreen display, and a control unit comprising a processor coupled to a non-transitory memory storing computer readable and executable instructions, the control unit being communicatively coupled to the reset actuator and the one or more user interface devices, wherein the control unit executes logic to:

receive a reset input from the one or more user interface devices; and move the switch from the open position to the closed position with the reset actuator and reset the emergency stop device when a reset input is received by the one or more user interface devices.

18. The rail-mounted lift system of claim 17, wherein:

the switch comprises a lever arm coupled to the emergency stop device, wherein movement of the lever arm moves the switch between the closed position and the open position.

19. The rail-mounted lift system of claim 18, wherein the reset actuator comprises:

a solenoid;

a plunger moveable by the solenoid;

a support linkage coupled to the plunger; and a catch arm coupled to the support linkage and comprising a catch surface, wherein the reset actuator is configured to move the catch surface to contact and move the lever arm to cause the switch to move from the open position to the closed position.

20. The rail-mounted lift system of claim 17, wherein upon receiving the reset input with the one or more user interface devices, the control unit displays a confirmation prompt with the touchscreen display to request that a user confirm the reset input.

* * * * *